US012396496B2

(12) United States Patent
Davis

(10) Patent No.: US 12,396,496 B2
(45) Date of Patent: Aug. 26, 2025

(54) GARMENT FOR FACILITATING URINATION

(71) Applicant: Angela Louise Davis, St. Peters, MO (US)

(72) Inventor: Angela Louise Davis, St. Peters, MO (US)

( * ) Notice: Subject to any disclaimer, the term of this patent is extended or adjusted under 35 U.S.C. 154(b) by 38 days.

(21) Appl. No.: 16/999,190

(22) Filed: Aug. 21, 2020

(65) Prior Publication Data

US 2021/0052021 A1 Feb. 25, 2021

Related U.S. Application Data

(60) Provisional application No. 62/891,245, filed on Aug. 23, 2019.

(51) Int. Cl.
*A41D 1/06* (2006.01)

(52) U.S. Cl.
CPC ..... *A41D 1/065* (2013.01); *A41D 2300/32* (2013.01); *A41D 2300/33* (2013.01)

(58) Field of Classification Search
CPC ..... A41B 9/004; A41B 9/005; A41B 9/007; A41D 1/065
See application file for complete search history.

(56) References Cited

U.S. PATENT DOCUMENTS 1,179,159 A * 4/1916 Buley ..... A41B 9/04 2/407
1,270,190 A * 6/1918 Morris ..... A41F 9/02 2/237
1,469,287 A * 10/1923 Torchia ..... A41B 9/04 2/408
2,014,802 A * 9/1935 Gulke ..... A41F 9/02 2/237
2,256,884 A * 9/1941 Boysen ..... A41B 9/14 2/404
2,281,872 A * 5/1942 Donnelly ..... A41F 9/025 2/237
2,334,144 A * 11/1943 Bono ..... A41D 1/21 D2/742
3,279,469 A * 10/1966 Schustack ..... A41C 1/003 2/408
3,793,646 A * 2/1974 Tempelhof ..... A41D 1/06 2/DIG. 1
3,974,836 A * 8/1976 Carlson ..... A41C 1/003 2/408
4,280,230 A * 7/1981 LaFleur ..... A61F 13/70 2/408
4,389,733 A * 6/1983 Boykins, Jr. ..... A41D 1/08 2/466
4,961,234 A * 10/1990 Leibman ..... A41D 1/06 2/408
5,926,851 A * 7/1999 Kovalik ..... A41D 13/1254 2/114

(Continued)

*Primary Examiner* — Sally Haden
(74) *Attorney, Agent, or Firm* — Armstrong Teasdale LLP

(57) ABSTRACT

A garment for facilitating urination includes two leg openings, and an access panel between the two leg openings. The access panel extends from a front of the garment to a back of the garment, wherein the access panel is coupled to the front of the garment with an attachment. The garment is configurable between an initial, closed configuration and a second, open configuration in which the access panel is at least partially detached from the garment.

19 Claims, 10 Drawing Sheets

(56) References Cited

U.S. PATENT DOCUMENTS 6,324,699 B1 * 12/2001 Cosmah ..... A41B 11/14 2/408
6,412,119 B1 * 7/2002 Robles ..... A41B 9/026 2/400
7,100,214 B1 * 9/2006 Murray ..... A41C 1/003 2/408
7,727,218 B2 6/2010 Lavon et al.
8,087,098 B2 * 1/2012 Kimberly ..... A41B 9/001 2/403
8,088,116 B2 1/2012 Kline et al.
8,479,320 B2 * 7/2013 Swafford ..... A41D 1/065 2/78.2
9,089,173 B2 * 7/2015 Krishnan ..... A41D 1/06
9,125,440 B1 * 9/2015 Guerrero ..... A41D 1/06
9,522,088 B2 12/2016 Ashton et al.
9,750,287 B2 * 9/2017 Cohen Larren ..... A41C 1/00
9,872,527 B2 * 1/2018 Boillat-Macon ... A41D 13/1254
10,034,504 B2 * 7/2018 Boyle ..... A41D 27/204
10,687,570 B2 * 6/2020 Strange ..... A41D 1/06
11,357,266 B1 * 6/2022 Connors ..... A41B 9/005
2006/0230503 A1 * 10/2006 Shterenberg ..... A41F 9/00 2/309
2013/0125293 A1 * 5/2013 Stearns ..... A41D 1/06 2/227
2014/0273735 A1 * 9/2014 Cohen Larren ..... A41C 1/00 450/92
2015/0313302 A1 * 11/2015 Boyle ..... A41D 27/28 2/227
2016/0345642 A1 * 12/2016 Brothers ..... A41D 13/065
2016/0360806 A1 * 12/2016 Thomas ..... A41D 13/1254
2017/0006925 A1 * 1/2017 Priest ..... A41C 1/06
2018/0206561 A1 * 7/2018 Moran ..... A41D 1/065
2018/0228665 A1 * 8/2018 Relekar ..... A41B 9/04
2019/0021416 A1 * 1/2019 Lai ..... A41D 13/1254
2019/0320737 A1 * 10/2019 Kiuchi ..... A41D 17/02
2021/0100681 A1 * 4/2021 Miles ..... A41B 9/14
2021/0352970 A1 * 11/2021 Monaco ..... A41B 9/005
2022/0133527 A1 * 5/2022 Brown ..... A41B 9/005 128/844

* cited by examiner

GARMENT FOR FACILITATING URINATION

CROSS-REFERENCE TO RELATED APPLICATIONS

This application claims priority to U.S. Provisional Patent Application Ser. No. 62/891,245, filed on Aug. 23, 2019, the disclosure of which is hereby incorporated by reference in its entirety.

BACKGROUND OF THE DISCLOSURE

The present disclosure relates generally to garments, and more specifically, to a garment for facilitating urination.

In typical pant-like garments, the garments have to be taken completely off or unbuttoned and unzipped before a wearer of the garment can urinate. These actions may be very difficult to achieve for elderly wearers and/or disabled wearers, and therefore, urination may be especially difficult for the wearers and any caretakers assisting the wearers.

Additionally, some wearers may not be able to urinate in a typical bathroom setting. For example, the wearers may need to urinate in a urination bottle or a bed pan. Typical pant-like garments do not provide privacy or cover for these unique circumstances.

SUMMARY OF THE DISCLOSURE

In one aspect, a garment for facilitating urination is provided. The garment includes two leg openings, and an access panel between the two leg openings. The access panel extends from a front of the garment to a back of the garment, wherein the access panel is coupled to the front of the garment with an attachment. The garment is configurable between an initial, closed configuration and a second, open configuration in which the access panel is at least partially detached from the garment.

In another aspect, a method of operating a garment is provided. The method includes providing a garment for facilitating urination. The garment includes two leg openings, and an access panel between the two leg opening. The access panel extends from a front of the garment to a back of the garment, wherein the access panel is coupled to the garment with an attachment. The garment is configurable between an initial, closed configuration and a second, open configuration in which the access panel is at least partially detached from the garment. The method also includes detaching, using an attachment, the access panel from the garment before a wearer of the garment urinates.

These other and features, aspects and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

Corresponding reference characters indicate corresponding parts throughout the several views of the drawings.

DETAILED DESCRIPTION OF THE DISCLOSURE

The present disclosure relates generally to garments, and more specifically, to a garment for facilitating urination.

Figure 1:
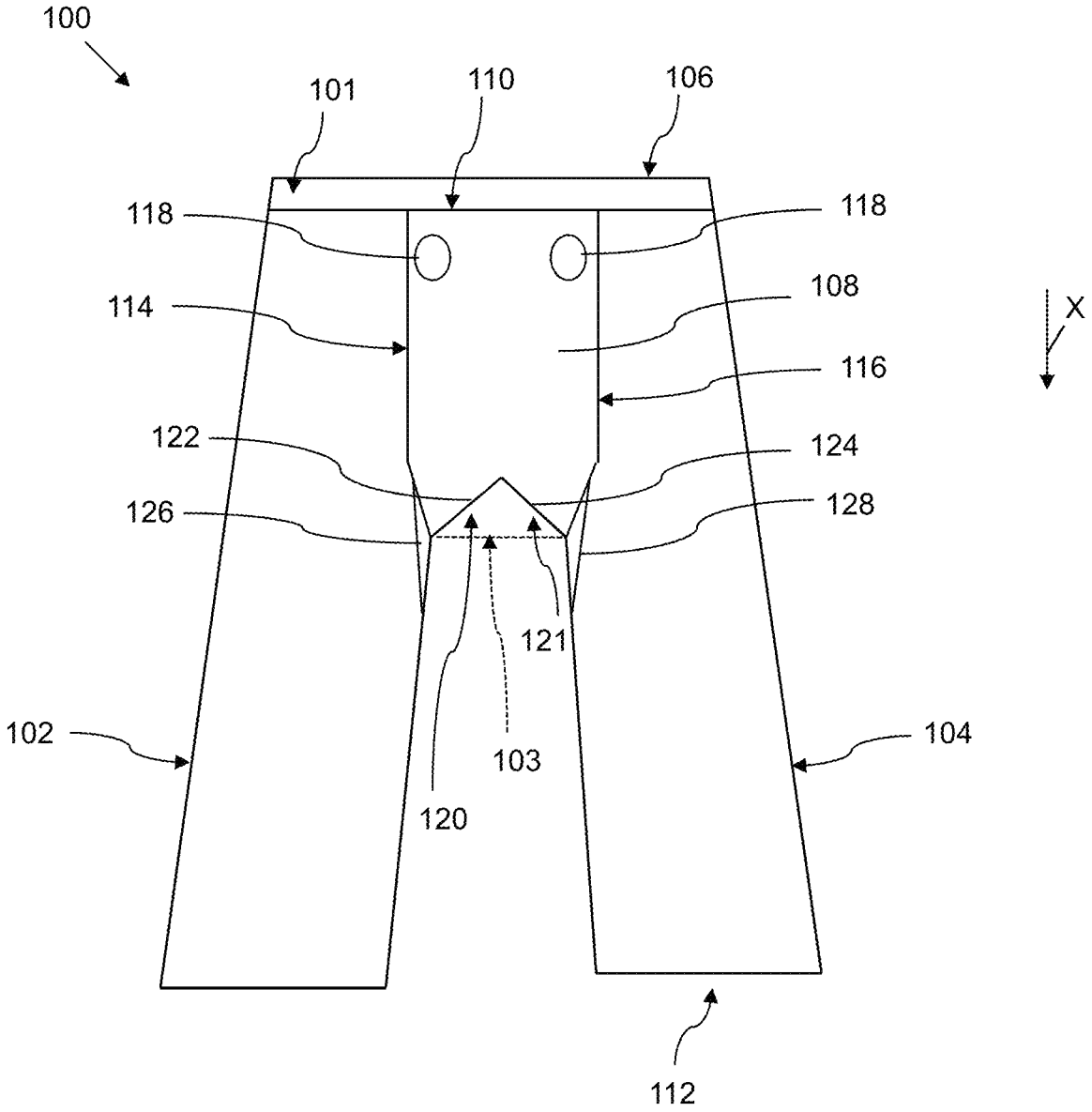
FIG. 1 is a front view of an exemplary garment in a closed or initial configuration.
Figure 2:
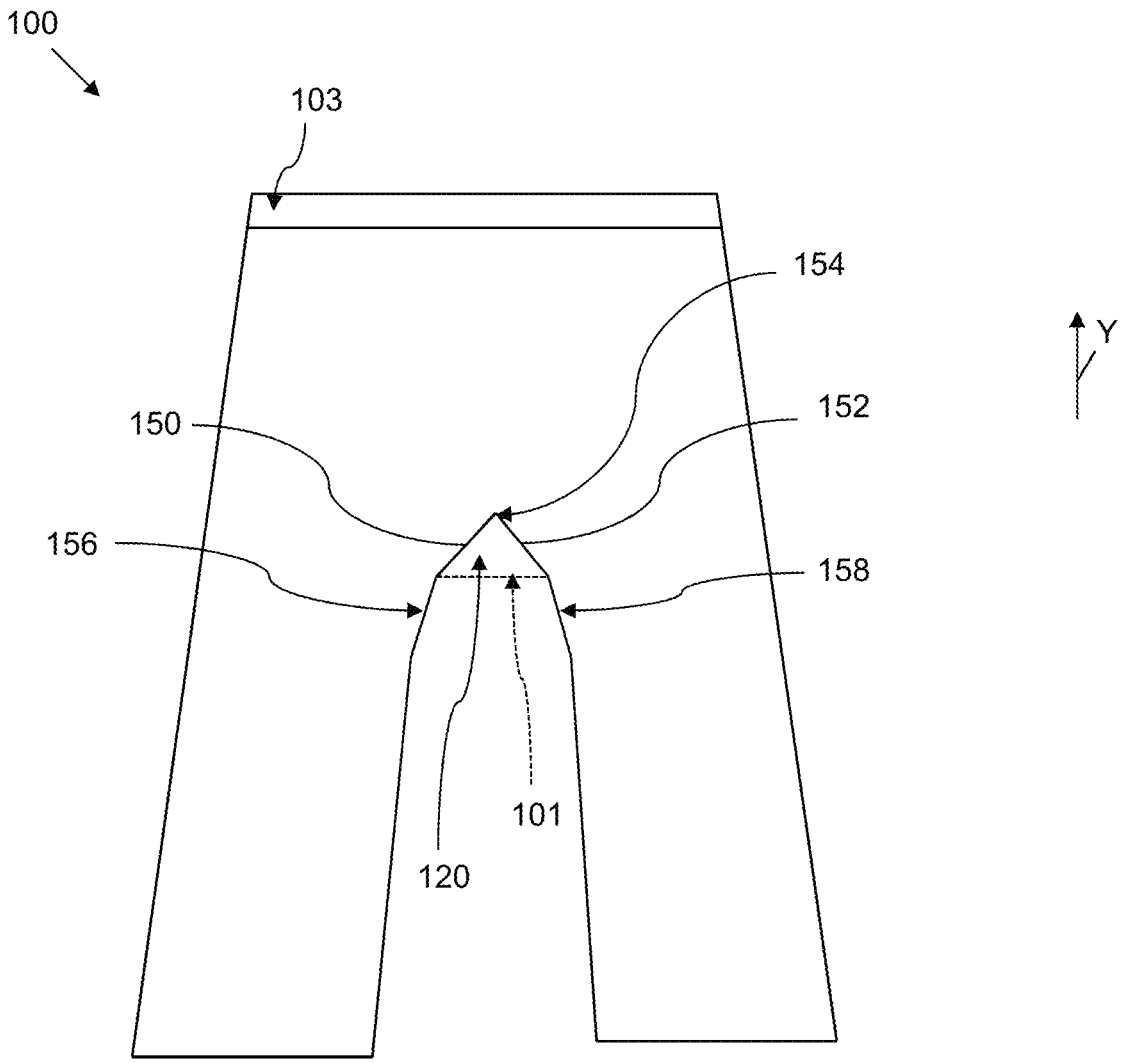
FIG. 2 is a back view of a first embodiment of the garment of FIG. 1.
Figure 3:
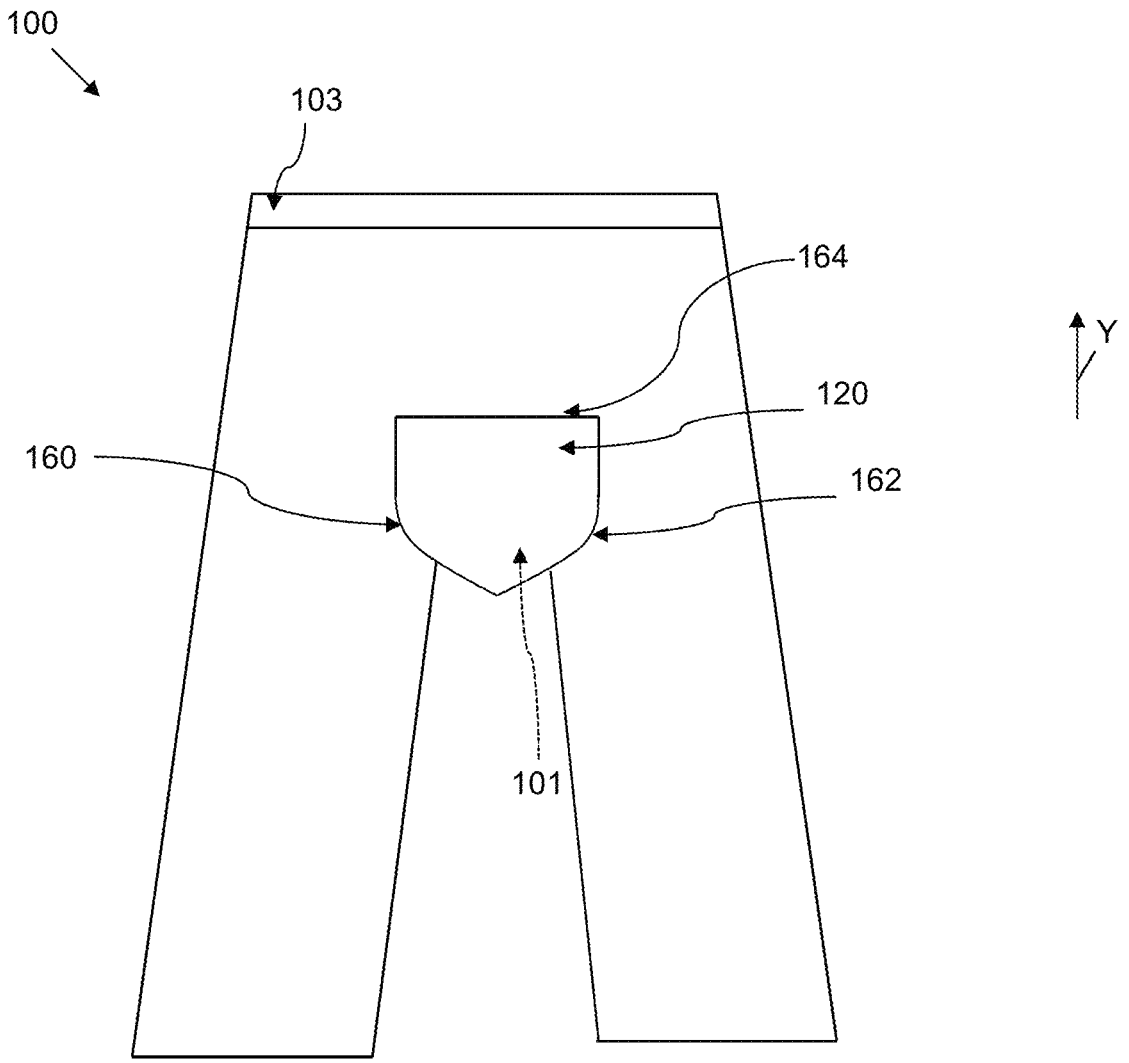
FIG. 3 is a back view of a second embodiment of the garment of FIG. 1.
Figure 4:
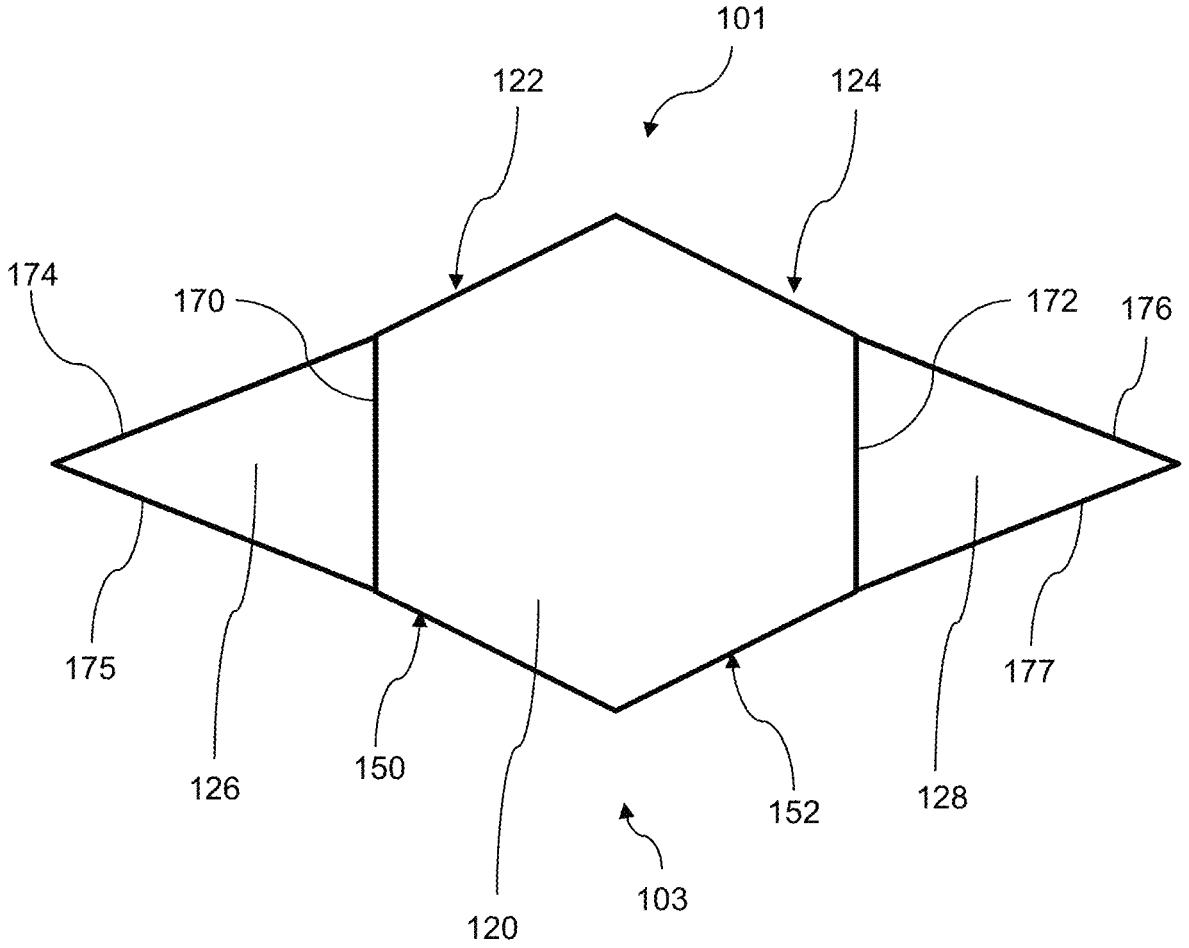
FIG. 4 is a bottom view of a bottom panel of the garment of FIG. 1.
Figure 5:
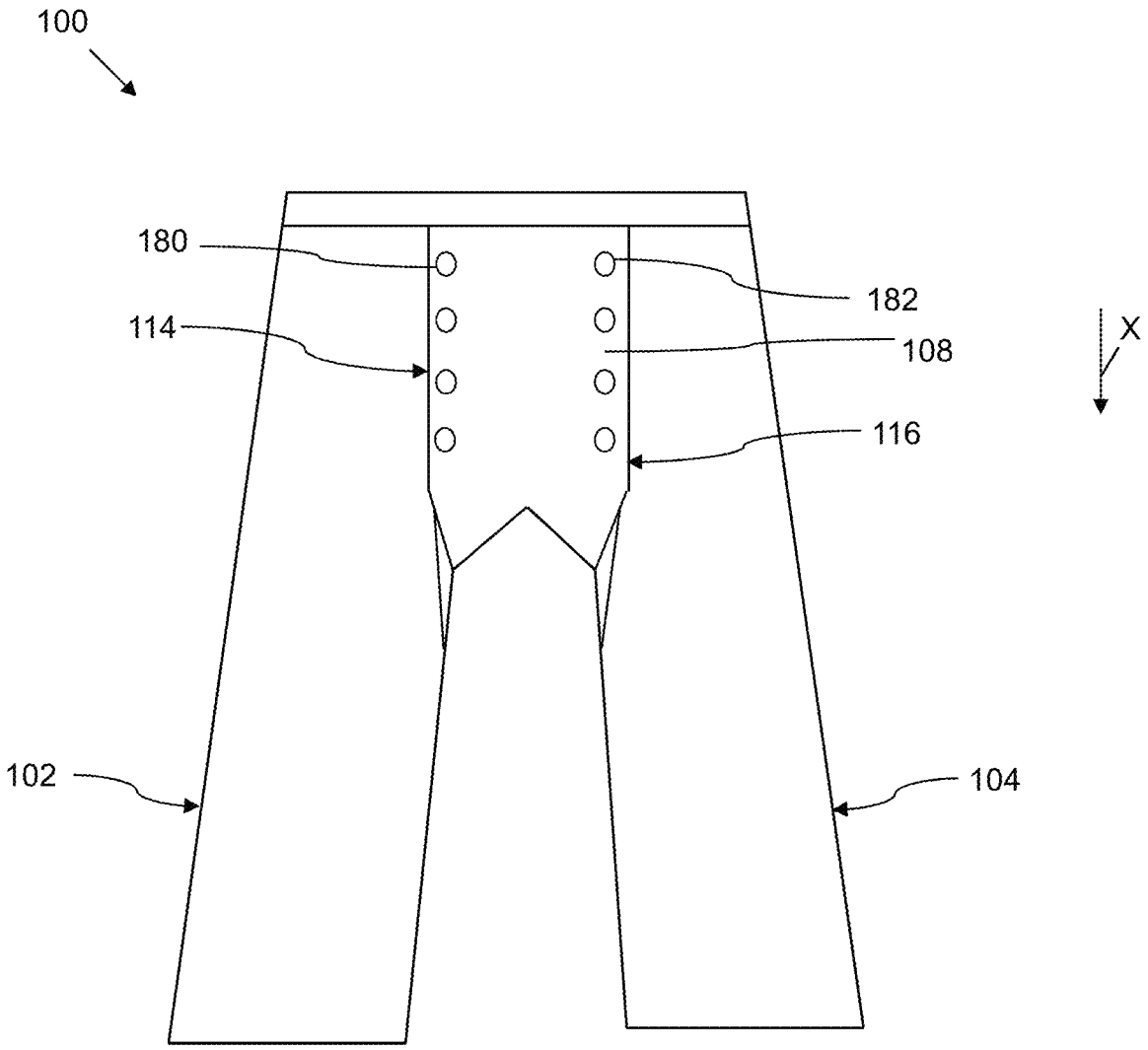
FIG. 5 is a front view of the garment of FIG. 1 with a first type of attachment.
Figure 6:
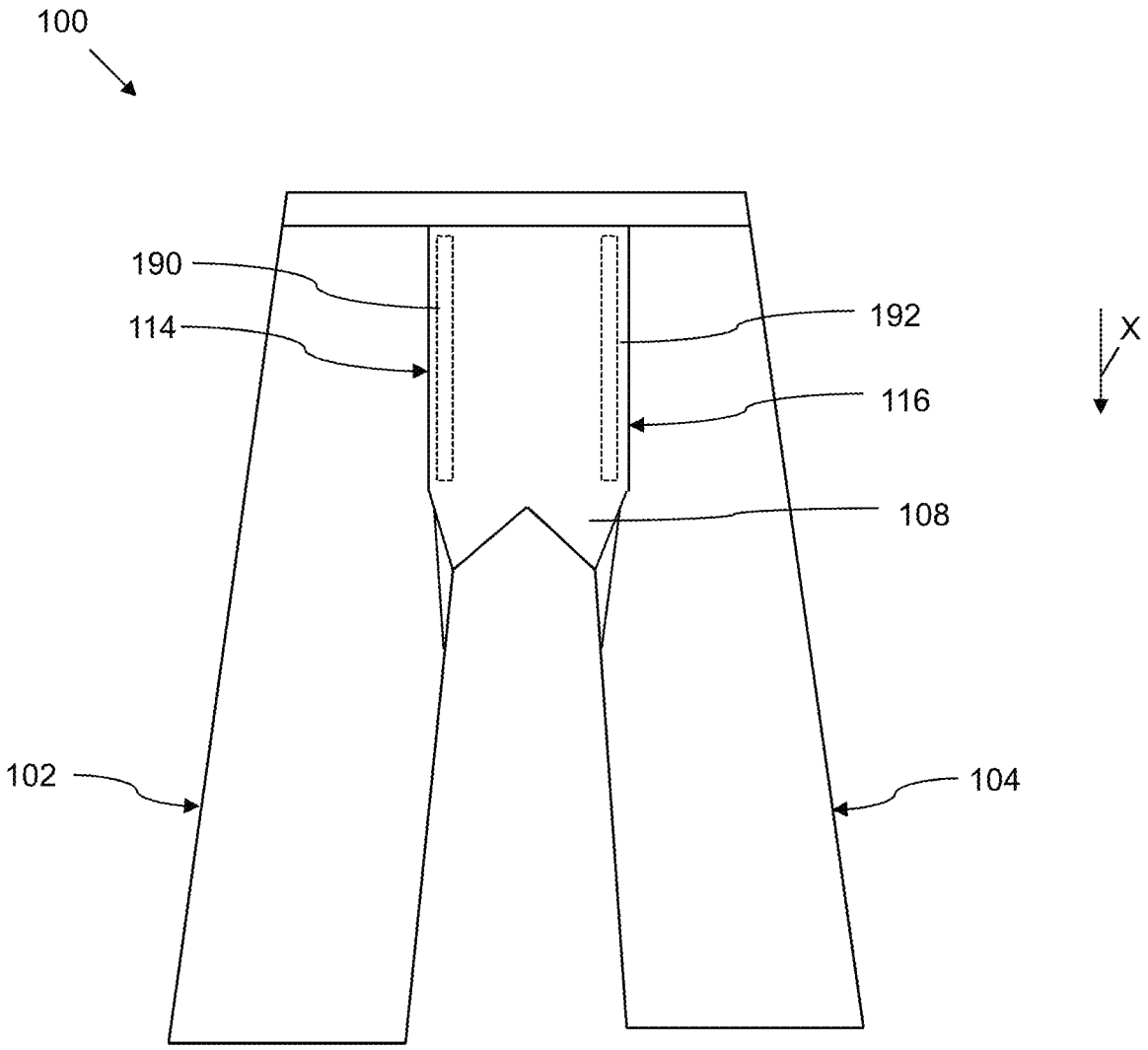
FIG. 6 is a front view of the garment of FIG. 1 with a second type of attachment.
Figure 7:
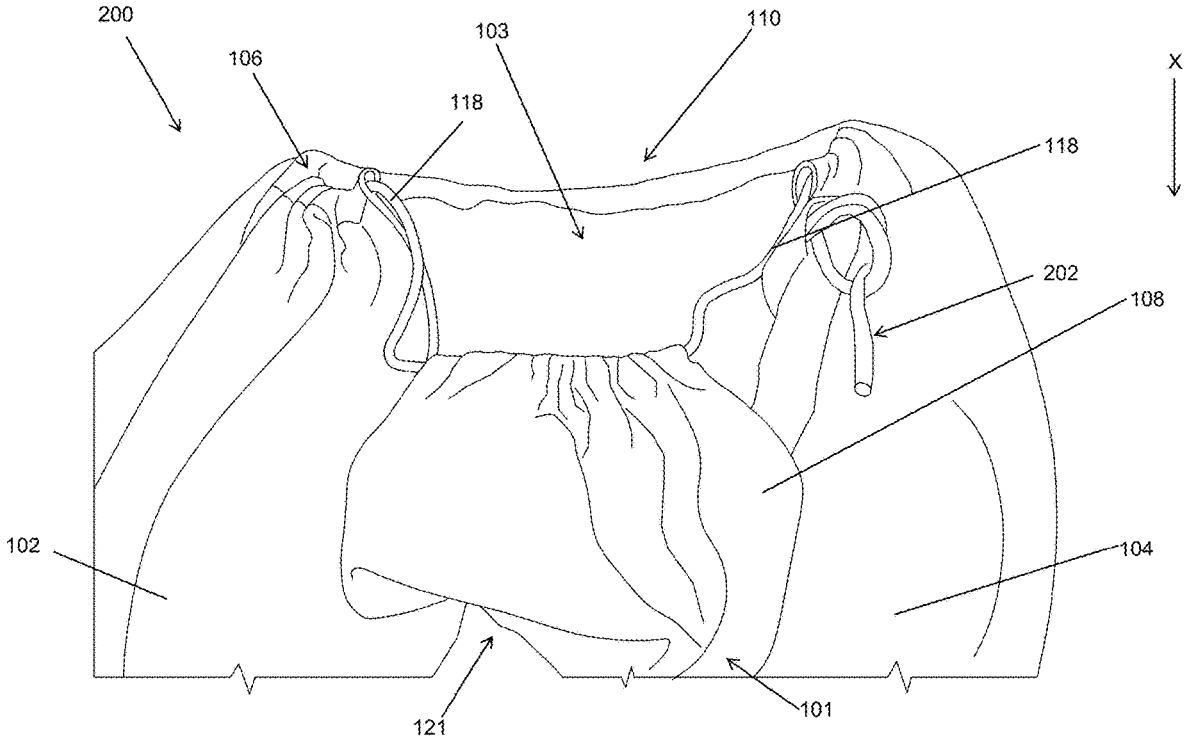
FIGS. 7-9 are front perspective views of the garment of FIG. 1 being positioned into an open or second configuration.
Figure 8:
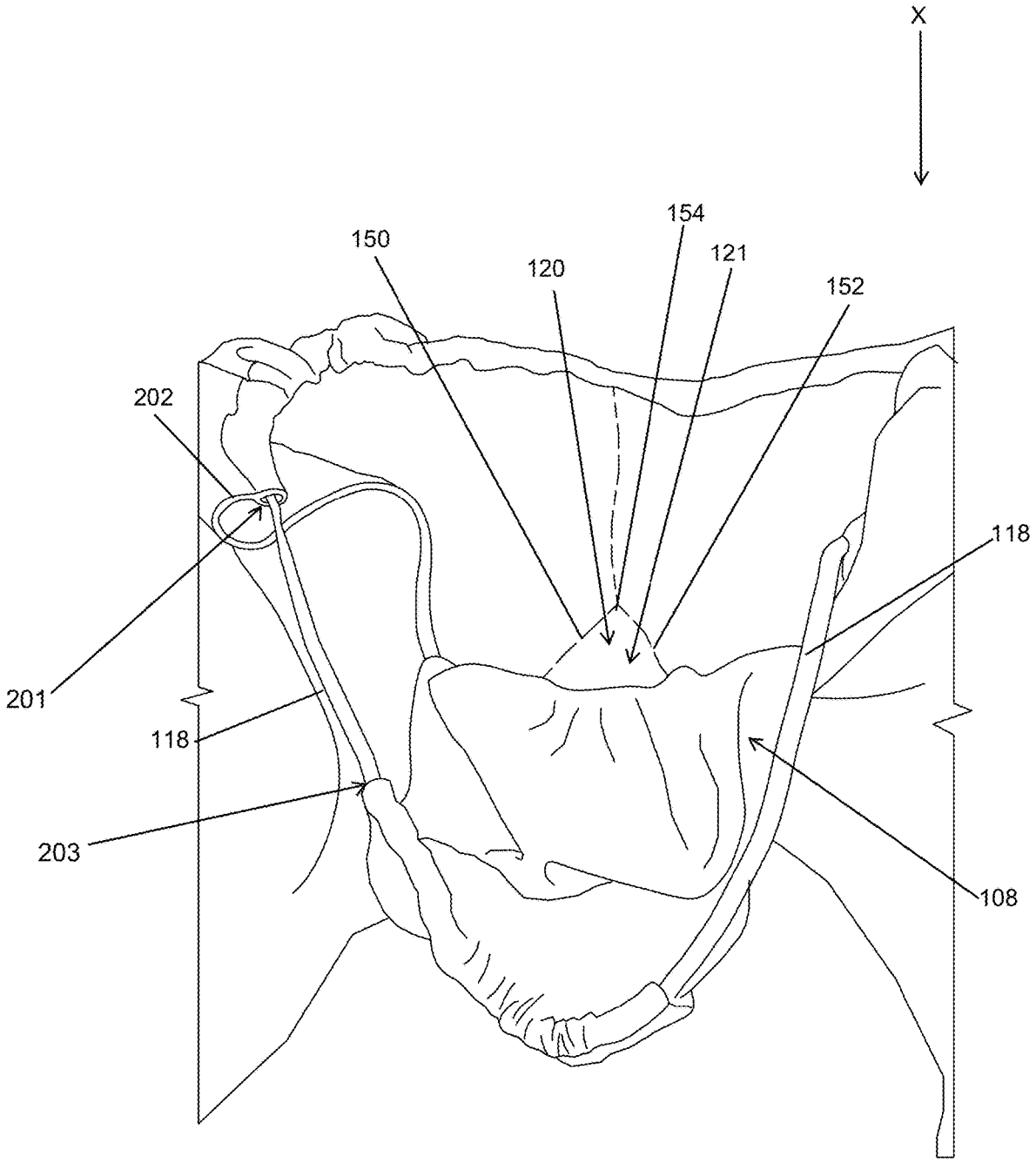
Figure 9:
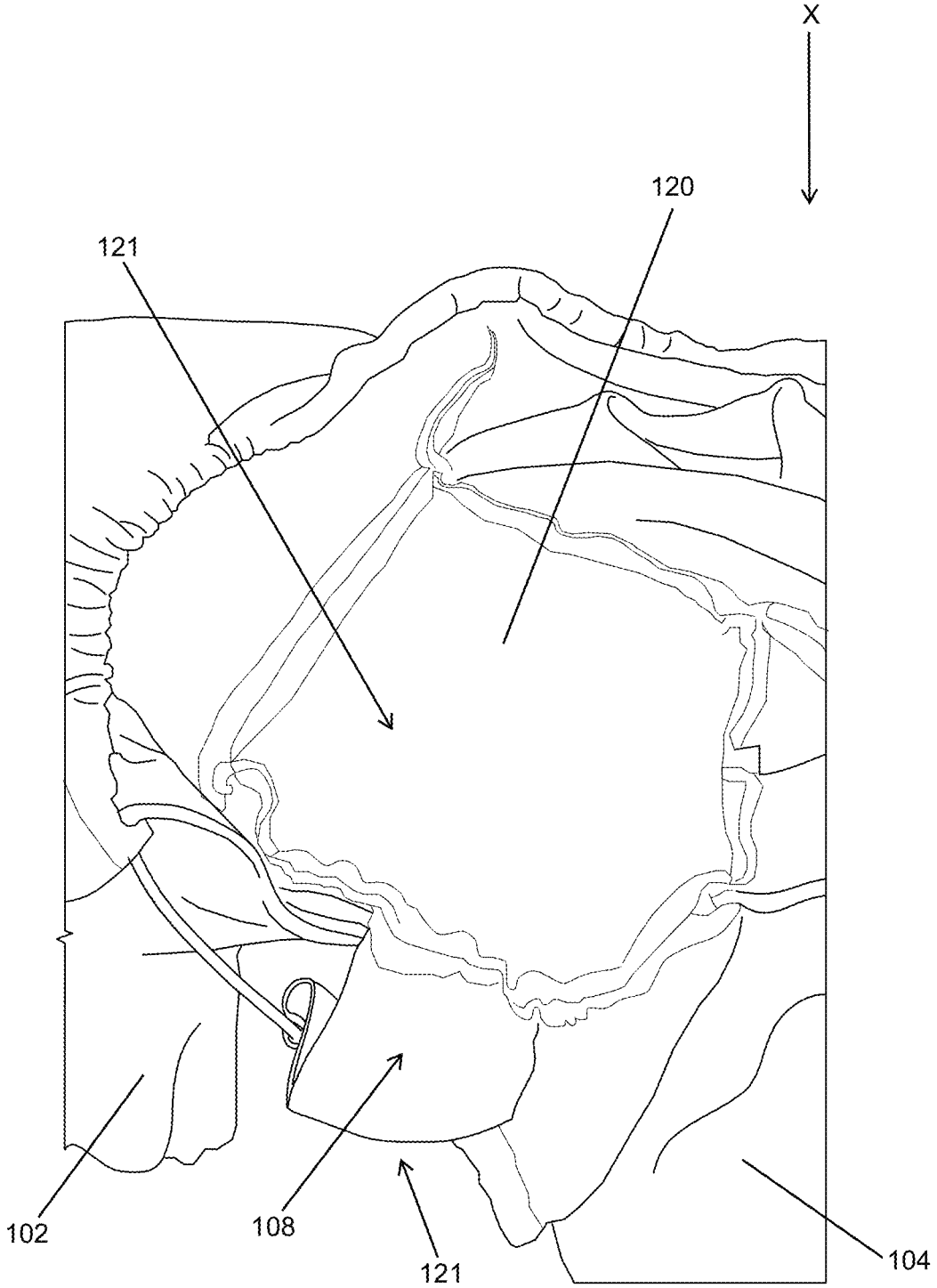

FIG. 1 is a front view of an exemplary garment 100 for facilitating urination in a closed or initial configuration. FIG. 2 is one embodiment of a back view of the garment 100, and FIG. 3 is another embodiment of a back view of the garment 100. FIG. 4 shows a bottom view of a bottom panel (e.g., bottom panel 120, shown in FIG. 1) of the garment 100. FIGS. 5 and 6 show two embodiments of the garment 100 with different attachments (e.g., attachment 118, shown in FIG. 1), and FIGS. 7-9 show an exemplary garment substantially similar to the garment 100 being positioned from a closed configuration to an open configuration. Although the garment 100 is described and shown herein as being a pant, specifically long pants, it should be understood that the garment 100 is not limited to a pant, and may instead be any garment 100 with leg openings including, for example and without limitation, shorts, underwear, boxers, briefs, long underwear, and pajamas.

In the exemplary embodiment, the garment 100 is constructed from a flexible cloth or textile material. For example, the garment 100 may be constructed of wool, cotton, silk, linen, crepe, polyester, velvet, chenille, fleece, chiffon, flannel terry cloth and any/all fabrics used in making any garment. In other embodiments, the garment 100 may be constructed from any other suitable material such that the garment 100 may function as described herein. Moreover, the garment 100 is constructed from several pieces of material that are coupled or secured together. The difference pieces may be made of the same material or different materials.

The garment 100 has a front 101 that is generally worn on a front of a user (not shown) when the garment 100 is worn by the user and a back 103 that is generally worn on a back of the user when the garment 100 is worn by the user. The garment 100 includes a first leg opening 102, a second leg opening 104, a waistband 106, and an access panel 108, also referred to herein as a panel 108. The leg openings 102, 104 extend from a top end 110 of the garment 100 to a bottom end 112 of the garment 100. The waistband 106 is located at the top end 110 of the garment 100. The panel 108 is located near the top end 110 of the garment 100. The panel 108 extends vertically from the front 101 of the garment 100 to the back 103 of the garment 100, and the panel 108 extends horizontally from a first end 114 of the panel 108 to a second end 116 of the panel 108. The panel 108 is removably coupled to the garment 100, and more specifically, to the first and second leg openings 102, 104, by attachments 118 (e.g., rope, buttons, snaps, hook-and-look fasteners, etc.). That is, when the garment 100 is in the closed configuration (shown in FIG. 1), the first end 114 of the panel 108 is coupled to the first leg opening 102 with the attachment 118 and the second end 116 of the panel 108 is coupled to the second leg opening 104 with the attachment 118. When the garment 100 is in the open configuration (shown in FIGS. 7-9) and moved in the direction of X, the first end 114 of the panel 108 is decoupled from the first leg opening 102 using attachment 118, and the second end 116 of the panel 108 is decoupled from the second leg opening 104 using attachment 118.

The panel 108 includes a bottom panel 120 in a crotch region 121 of the garment 100. In the exemplary embodiment, the bottom panel 120 is a distinct panel that is coupled to the panel 108 (e.g., through stitching or other attachment means). In other embodiments, the bottom panel 120 is not distinct from the panel 108 and is the portion of the panel 108 that is in the crotch region 121 of the garment 100. The panel 108, and more specifically, the bottom panel 120 includes a first front panel edge 122 and a second front panel edge 124. The first front panel edge 122 and the second front panel edge 124 meet generally in the middle of the panel 108. In the exemplary embodiment, the front panel edges 122, 124 are slanted such that the front panel edges 122, 124 form a generally triangular shape in the crotch region 121 of the garment 100 and such that the bottom panel 120 is generally hexagonal in shape (as shown in FIG. 4). In other embodiments, the panel 108 may include any number of panel edges such that the crotch region 121, the panel 108, and/or the bottom panel 120 may be any suitable shape.

In the exemplary embodiment, the garment 100 includes a first leg extension 126 of first leg opening 102 and a second leg extension 128 of second leg opening 104. The first leg extension 126 extends from the first end 114 of the panel 108 through at least a partial length of the first leg opening 102. The second leg extension 128 extends from the second end 116 of the panel 108 through a partial length of the second leg opening 104. In the exemplary embodiment, the leg extensions 126, 128 are generally triangular in shape (as shown in FIG. 4). In other embodiments, the leg extensions 126, 128 may be any suitable shape. In the exemplary embodiment, the leg extensions 126, 128 are configured to give a user of the garment 100 extra space in the crotch region 121 and the leg openings 102, 104 when the user wears the garment 100. For example, the extra space due to the leg extensions 126, 128 may be especially useful when the user is wearing a diaper underneath the garment 100. In other embodiments, the garment 100 may not include leg extensions 126, 128.

FIG. 2 shows a first embodiment of the back 103 of the garment 100. The back 103 includes a first back panel edge 150 of the panel 108, shown in FIG. 1, (and more specifically, the bottom panel 120) and a second back panel edge 152 of the panel 108 (and more specifically, the bottom panel 120). In the exemplary embodiment, the back panel edges 150, 152 are slanted such that the back panel edges 150, 152 meet at an end 158. Further, the back panel edges 150, 152 are configured to form a generally triangular shape in the crotch region 121 (shown in FIG. 1) of the garment 100 and such that the bottom panel 120 is generally hexagonal in shape (as shown in FIG. 4). The back 103 also shows a first extension 156 and a second extension 158 that come from the first leg extension 126 and the second leg extension 128, respectively.

In the exemplary embodiment, the panel 108 and the bottom panel 120 extend from the front 101 of the garment 100 to the end 154. When the garment 100 is positioned to the open configuration (shown in FIGS. 7-9), the panel 108 and the bottom panel 120 move in the direction of Y. The panel 108 and the bottom panel 120 stop moving at the end 154 (e.g., when the garment 100 is fully in the open configuration).

FIG. 3 shows a second embodiment of the back 103 of the garment 100. The back 103 includes a first back panel edge 160 of the panel 108 (and more specifically, the bottom panel 120) and a second back panel edge 162 of the panel 108 (and more specifically, the bottom panel 120). In the exemplary embodiment, the back panel edges 160, 162 are generally curved in shape and are connected by an ending edge 164 of the panel 108 and the bottom panel 120. Further, the back panel edges 160, 162 are configured such that the bottom panel 120 is polygonal in shape, and more specifically, heptagonal in shape.

In the exemplary embodiment, the panel 108 and the bottom panel 120 extend from the front 101 of the garment to the ending edge 164. When the garment 100 is positioned to the open configuration (shown in FIGS. 7-9), the panel 108/the bottom panel 120 move in the direction of Y. The panel 108 and the bottom panel 120 stop moving at the ending edge 164 (e.g., when the garment 100 is fully in the open configuration).

FIG. 4 shows a simplified bottom view of the crotch region 121 of the garment 100 (shown in FIGS. 1 and 2). Specifically, FIG. 4 shows a bottom view of the bottom panel 120 and the leg extensions 126, 128 of the garment 100. As explained with respect to FIGS. 1 and 2, the front 101 of the bottom panel 120 includes front panel edges 122, 124, and the back 103 of the bottom panel 120 includes back panel edges 150, 152. The bottom panel 120 also includes a first side panel edge 170 and a second side panel edge 172. The first leg extension 126 includes a first extension edge 174 coupled to the front 101 of the first leg opening 102 (shown in FIG. 1) and a second extension edge 175 coupled to the back 103 of the first leg opening 102 (shown in FIG. 2). The second leg extension 128 includes a third extension edge 176 coupled to the front 101 of the second leg opening 104 (shown in FIG. 1) and a fourth extension edge 177 coupled to the back 103 of the second leg opening 104 (shown in FIG. 2). The extensions edges 174, 175, 176, 177 may be coupled to the respective first and second leg openings 102, 104 by any suitable means, including, but not limited to, stitching.

The first leg extension 126 extends from the first side panel edge 170 down a length of the first leg opening 102, and the second leg extension 128 extends from the second side panel edge 172 down a length of the second leg opening 104. In the exemplary embodiment, the leg extensions 126, 128 are triangular in shape to maximize the amount of space the leg extensions 126, 128 provide without compromising the comfort of the garment 100. For example, if the leg extensions 126, 128 were square in shape, the leg extensions may provide more space, but the corners of the square-shaped leg extensions may irritate the skin of the user and be uncomfortable for the user.

In the exemplary embodiment, the bottom panel 120 is hexagonal in shape. The hexagonal shape of the bottom panel 120 allows for easy access to a crotch region of the user (e.g., when the user urinates) such that the user can urinate in any position (e.g., standing up, sitting down, laying down, etc.). The hexagonal shape also allows for flexibility of the garment 100 and the bottom panel 120 without the garment 100 or the bottom panel 120 bunching up. Furthermore, the hexagonal and triangular shapes allow for the extra fabric between the legs and inseams to use a urine bottle quickly, pull out a soiled diaper, and solve the problem of waiting on assistance to urinate while in a seated position. The extra fabric will also eliminate tight fabric being caught up in the buttock and crotch areas of both men and women. Although the bottom panel 120 is shown as having a hexagonal shape in the exemplary embodiment, the bottom panel 120 can have any polygonal shape. For example, in other embodiments, the bottom panel 120 may have a pentagonal shape, a heptagonal shape, an octagonal shape, etc.

FIG. 5 shows an exemplary embodiment of the garment 100 with a first exemplary attachment 118 (shown in FIG. 1) of buttons or snaps. Specifically, the garment 100 includes a plurality of buttons 180 or snaps 180 near the first end 114 of the panel 108 and a plurality of buttons 182 or snaps 182 near the second end 116 of the panel 108 to secure the panel 108 to the first and second leg openings 102, 104 when the garment 100 is in the closed configuration. In the exemplary embodiment, the buttons 180 are coupled to the first leg opening 102 (e.g., through stitching), and the panel 108 includes a plurality of holes (not shown) near the first end 114 configured to receive the buttons 180. The buttons 182 are coupled to the second leg opening 104 (e.g., through stitching), and the panel 108 includes a plurality of holes (not shown) near the second end 116 configured to receive the buttons 182. The garment 100 is in the closed configuration when the buttons 180, 182 secure the corresponding holes of the panel 108.

When the garment 100 is positioned into the open configuration, the buttons 180, 182 are undone (e.g., the buttons 180, 182 release the corresponding holes) from the top 110 (shown in FIG. 1) of the garment 100 to the bottom panel 120 (shown in FIG. 1) of the garment 100 in the direction of X. When the garment 100 is positioned into the closed configuration from the open configuration, the buttons 180, 182 are redone (e.g., the buttons 180, 182 are received in the corresponding holes) from the bottom panel 120 of the garment 100 to the top 110 of the garment 100 in a direction opposite of X, such that the panel 108 is secured to the leg openings 102, 104 by the buttons 180, 182.

If the buttons are snaps, one part of the snaps 180 is coupled to the leg opening 102, and the other part of the snaps 180 is coupled near the first end 114 of the panel 108. Further, one part of the snaps 182 is coupled to the leg opening 104, and the other part of the snaps 182 is coupled near the second end 116 of the panel 108. The one part of the snaps 180, 182 on the leg openings 102, 104 are each configured to align with the other part of the snaps 180, 182 on the panel 108.

When the garment 100 is positioned into the open configuration, the snaps 180, 182 are undone (e.g., the one part and the other part are decoupled) from the top 100 of the garment 100 to the bottom panel 120 of the garment in the direction of X. When the garment 100 is positioned into the closed configuration from the open configuration, the snaps 180, 182 are re-snapped (e.g., the one part of the snaps 180, 182 receives the other part of the snaps 180, 182) from the bottom panel 120 of the garment 100 to the top 110 of the garment 100 in a direction opposite X, such that the panel 108 is secured to the leg openings 102, 104 by the snaps 180, 182.

FIG. 6 shows an exemplary embodiment of the garment 100 with a second exemplary attachment 118 (shown in FIG. 1) of hook-and-loop fasteners (e.g., VELCRO). Specifically, the garment 100 includes a hook-and-loop fastener strip 190 near the first end 114 of the panel 108 and a hook-and-loop fastener strip 192 near the second end 116 of the panel 108 to secure the panel 108 to the first and second leg openings 102, 104 when the garment 100 is in the closed configuration. A first part of the hook-and-loop fastener strips 190, 192 (e.g., either the "hook" or the "fastener") is coupled (e.g., through stitching) to the first and second leg openings 102, 104, respectively. Another part of the hook-and-loop fastener strips 190, 192 (e.g., the other of the "hook" or the "fastener") is coupled to the first and second ends 114, 116, respectively, such that both parts of the hook-and-loop fastener strips line up when the garment 100 is in the closed configuration. That is, the garment 100 is in the closed configuration when the hook-and-loop fastener strips 190, 192 secure the panel 108 to the leg openings 102, 104.

When the garment 100 is positioned into the open configuration, the two parts of the hook-and-loop fastener strips 190, 192 are decoupled (e.g., through pulling the two parts away from each other) from the top 110 (shown in FIG. 1) of the garment 100 to the bottom panel 120 (shown in FIG. 1) of the garment 100 in the direction of X. When the garment 100 is positioned into the closed configuration from the open configuration, the hook-and-loop f fastener strips 190, 192 are coupled together (e.g., by sticking the parts of the strips 190, 192 back together) from the bottom panel 120 of the garment 100 to the top 100 of the garment in a direction opposite of X, such that the panel 108 is secured to the leg openings 102, 104 by the hook-and-loop fastener strips 190, 192.

Although the attachments 118 (shown in FIG. 1) are shown as being buttons, snaps, or hook-and-loop fastener strips, the attachments 118 can be any other suitable attachment that is removable and/or non-permanent. For example, the attachments 118 may be a rope, as shown in FIGS. 7-9. Further, the attachments 118 may include, for example, fabric tape or elastic. The removable attachments 118 that secure the panel 108 to the first and second leg openings 102, 104 ensure that users are easily able to access a crotch region of the user without the user having to take off the garment 100. This is especially useful when, for example, the user needs to urinate.

FIGS. 7-9 show an exemplary garment 200 being positioned from a closed configuration to an open configuration. The garment 200 is substantially similar to the garment 100 (shown in FIG. 1) and includes substantially similar parts. FIG. 7 shows the panel 108 in a first intermediate configuration between the closed configuration and the open configuration, FIG. 8 shows the panel 108 in a second intermediate configuration between the first intermediate configuration and the open configuration, and FIG. 9 shows the panel 108 (and the garment 200) in the open configuration.

In the illustrated embodiment, the attachment 118 of the garment 200 is rope 118. Specifically, the rope 118 wraps around the garment 200 and is placed in a first passageway 201 (shown in FIG. 8) defined in the waistband 106. The rope 118 is also coupled to the panel 108 and extends through a second passageway 203 (shown in FIG. 8) defined in the panel 108. The rope 118 ties, as shown as 202, on one side of the garment 200 between the panel 108 and the waistband 106. When the garment 200 is in the closed configuration (not shown), the rope 118 is pulled taut throughout the panel 108 and tied 202 at one end of the panel 108 such that the panel 108 and the waistband 106 are flush at the top of the garment 200. As shown in FIG. 7, the tie 202 is untied such that the panel 108 can be lowered into the open configuration (e.g., toward the crotch region 121 of the garment 200 in the direction of X).

FIG. 8 shows the garment 200 in the second intermediate position (e.g., as the panel 108 is further lowered in the direction of X from the first intermediate position shown in FIG. 7). The bottom panel 120 is visible in the second intermediate position, as are the back panel edges 150, 152 and the ending 154. As the panel 108 is pulled lower, the tie 202 gets smaller as the rope 118 needs more slack to stay coupled to the panel 108.

FIG. 9 shows the garment 200 in the open configuration. In the open configuration, the panel 108 is pulled completely down to the crotch region 121 (e.g., adjacent leg openings 102, 104). In the open configuration, since the panel 108 is completely lowered, the user of the garment 200 can easily urinate without having to take off the garment 200 completely. Further, the bottom panel 120 is configured to make the garment 200 flexible without bunching up and allows the user to urinate from any position (e.g., standing up, sitting down, laying down, etc.). When the user has finished urinating, the panel 108 can easily be pulled up to be flush with the waistband 106 again, and the panel 108 is secured by tying the rope 118.

Figure 10:
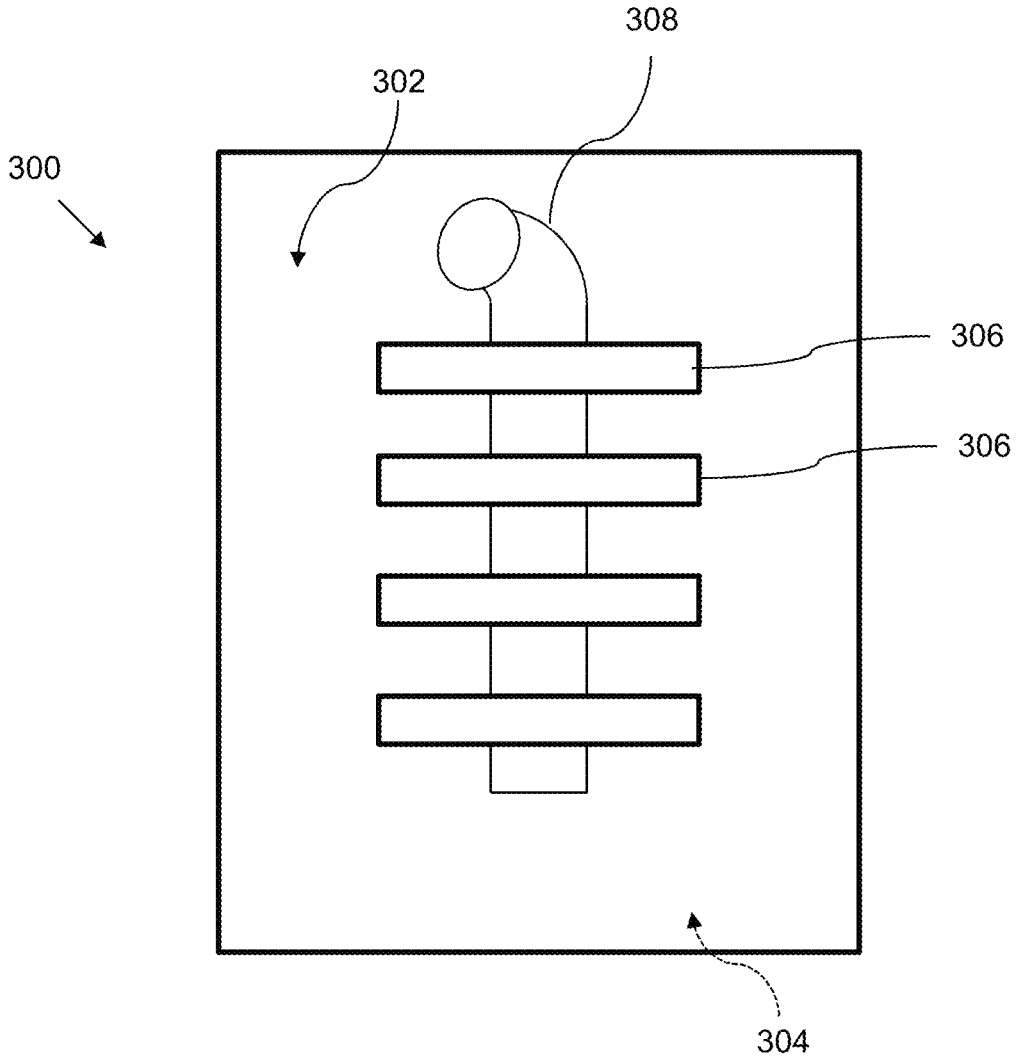
FIG. 10 is a back view of a blanket that may be used in association with the garment of FIG. 1.

FIG. 10 shows a blanket 300 that may be used in association with the garment 100 (shown in FIG. 1). The blanket 100 has a back side 302, which is shown in FIG. 10, and a front side 304. The back side 302 includes a plurality of fasteners 306 configured to hold a bottle 308 or other urination-assist device 308. The fasteners 306 may be constructed of elastic and/or hook-and-loop fasteners.

When a user of the garment 100 needs to urinate and the garment 100 is in the open configuration, the user may use the blanket 300 to discreetly urinate. Specifically, the user may urinate into the bottle 308 fastened in place by the fasteners 306 of the blanket 300. That is, the back side 302 of the blanket 300 is in contact with the user such that the front side 304 of the blanket hides the urine and urination of the user.

As described above, the garment 100 facilitates urination by providing an access panel (e.g., panel 108) such that a user of the garment can easily access a crotch area of the user when the user has to urinate. The access panel ensures that the user does not have to completely take off the garment 100 when the user has to urinate. Further, by providing a bottom panel (e.g., bottom panel 120) of the access panel, the garment 100 is more flexible without bunching up, and the user can urinate from any position (e.g., standing up, sitting down, laying down, etc.). In some embodiments, the garment 100 also provides leg extensions (e.g., leg extensions 126, 128) that are configured to provide more space in a crotch region of the user and down the legs of the user. The leg extensions may accordingly be especially useful for users who wear diapers or other bulky underwear underneath the garment 100.

Accordingly, the garment 100 is especially useful in facilitating urination for users who are elderly, incontinent, or disabled due to the garment 100 not having to be taken off to urinate. Further, the garment 100 is also useful to caretakers of the users of the garment 100, as the caretakers can easily assist the users in urinating because garment 100 can stay on while the user is urinating, and the caretakers do not have to take the garment 100 on and off.

Although the embodiments and examples disclosed herein have been described with reference to particular embodiments, it is to be understood that these embodiments and examples are merely illustrative of the principles and applications of the present disclosure. It is therefore to be understood that numerous modifications can be made to the illustrative embodiments and examples and that other arrangements can be devised without departing from the spirit and scope of the present disclosure as defined by the claims. Thus, it is intended that the present application cover the modifications and variations of these embodiments and their equivalents.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A garment for facilitating urination, the garment comprising:

a front side;

a back side;

a first leg opening and a second leg opening each defined by the front side and the back side;

a waistband at a top end of the garment defining a first passageway;

an access panel assembly between the first leg opening and the second leg opening and extending from the front side of the garment to the back side of the garment, the access panel assembly comprising:

an access panel positioned on the front side and defining a second passageway at a top of the access panel, the access panel extending horizontally from a first free edge to a second free edge; and a bottom panel in a crotch region of the garment coupled to the access panel, wherein the first free edge of the access panel extends from the bottom panel and to the second passageway at the first leg opening and the second free edge of the access panel extends from the bottom panel to the second passageway at the second leg opening:

a first back panel edge and a second back panel edge on the bottom panel coupling the access panel assembly to the back side of the garment;

a first front panel edge and a second front panel edge on the bottom panel coupling the access panel to the bottom panel, the first front panel edge intersecting the second front panel edge, and wherein the first front panel edge is oriented obliquely relative to the second front panel edge; and an attachment coupling the access panel to the front side of the garment, the attachment including a tightening rope extending through the first passageway in the waistband and the second passageway in the access panel, wherein the garment is configurable by the tightening rope to an open configuration in which the access panel is at least partially detached from the garment, wherein the tightening rope wraps around the circumference of the top end of the garment through the waistband and the access panel, and wherein loosening the tightening rope lowers the second passageway on the garment relative to the first passageway, moves the first free edge away from the first leg opening, and moves the second free edge away from the second leg opening, to lower the access panel on the front side and allow for maintaining the waistband in position on a wearer.

2. The garment of claim 1, wherein the first and second front panel edges meet in a center region of the access panel.

3. The garment of claim 1, wherein the bottom panel has a polygon shape, and wherein the polygon shape has at least five sides.

4. The garment of claim 3, wherein the bottom panel has a hexagon shape.

5. The garment of claim 1, wherein the first leg opening and the second leg opening each extend to a bottom of the garment, and wherein the first leg opening and the second leg opening each have a same length.

6. The garment of claim 1 further comprising:

leg extensions extending from the bottom panel to at least a partial length of each of the first leg opening and the second leg opening.

7. The garment of claim 6, wherein the leg extensions have a triangular shape.

8. The garment of claim 1, wherein the waistband is configured to change a size of the top end of the garment.

9. The garment of claim 1, wherein the garment is configured to the open configuration by untying the tightening rope to release the access panel from the garment.

10. The garment of claim 1, wherein the garment is composed of a textile material including at least one of cotton and polyester.

11. The garment of claim 1, wherein the tightening rope is configured to be pulled taut through the access panel and tied with a tie at one end of the access panel.

12. The garment of claim 11, wherein the garment is configurable to an intermediate configuration by loosening the tie to provide slack to the tightening rope within the waistband and allowing the top of the access panel to lower relative to the waistband, and wherein, in the open configuration, the access panel is positioned downward from the intermediate configuration and adjacent the crotch region and the two leg openings.

13. The garment of claim 1, wherein the first back panel edge and the second back panel edge intersect at an ending of the bottom panel, the first back panel edge and the second back panel edge each slanting outward relative to one another from the ending such that the first back panel edge and the second back panel edge collectively define a triangular shape in the crotch region, wherein the bottom panel further includes:

a first side panel edge and a second side panel edge, the first side panel edge extending from the first back panel edge to the first front panel edge, the second side panel edge extending from the second back panel edge to the second front panel edge, the second side panel edge being oriented parallel to the first side panel edge, and wherein the garment further includes a first leg extension extending from the first side panel edge down the first leg opening and a second leg extension extending from the second side panel edge down the second leg opening.

14. The garment of claim 13, wherein the bottom panel has a hexagon shape defined by the first back panel edge, the second back panel edge, the first side panel edge, the second side panel edge, the first front panel edge, and the second front panel edge.

15. The garment of claim 13, wherein the first leg extension includes a first extension edge coupled to the front side of the garment at the first leg opening and a second extension edge coupled to the back side of the garment at the first leg opening.

16. The garment of claim 15, wherein the first leg extension has a triangular shape defined by the first extension edge, the second extension edge, and the first side panel edge.

17. The garment of claim 16, wherein the first side panel edge extends from a first end to a second end, the first extension edge extending from the first end of the first side panel edge and the second extension edge extending from the second end of the first side panel edge.

18. The garment of claim 17, wherein the first front panel edge extends to the first end of the first extension edge and the first back panel edge extends to the second end of the first extension edge.

19. The garment of claim 18, wherein the first front panel edge is oriented parallel to the second back panel edge and the second front panel edge is oriented parallel to the first back panel edge.

* * * * *